United States Patent [19]

Pratt

[11] Patent Number: 4,913,940

[45] Date of Patent: Apr. 3, 1990

[54] WHIRLING BANNER OR KERCHIEF

[76] Inventor: Richard J. Pratt, 1390 Carol La., Deerfield, Ill. 60015

[21] Appl. No.: 153,729

[22] Filed: Feb. 9, 1988

[51] Int. Cl.[4] ..... G09F 17/00; G09F 21/02

[52] U.S. Cl. ..... 428/7; 446/236

[58] Field of Search ..... 116/173, 209; 446/236; 428/4, 5, 7, 28; 273/104

[56] References Cited

U.S. PATENT DOCUMENTS

| | | | |
|---|---|---|---|
| 3,715,821 | 2/1973 | Hawes | 116/173 X |
| 4,040,625 | 8/1977 | Malafronte | 446/236 X |
| 4,369,215 | 1/1983 | Offen et al. | 28/147 X |
| 4,488,372 | 12/1984 | Lowen | 428/4 X |

FOREIGN PATENT DOCUMENTS

| | | | |
|---|---|---|---|
| 0169131 | 1/1986 | European Pat. Off. | 116/173 |

*Primary Examiner*—Daniel M. Yasich

*Attorney, Agent, or Firm*—Cushman, Darby & Cushman

[57] ABSTRACT

A whirling banner having a handle, an axle portion disposed on the handle, a banner, and a radial arm having means for attaching the banner at one end and means for rotatingly supporting the axle at the other end. The radial arm is preferably constructed of two halves folded over one another, defining a fold at one end. At the end opposite the fold, the radial arm has a barb on one half for piercing and attaching the banner. The barb engages a hole on the other half and holds the two halves of the arm together. The end of the arm closest the fold has a hole passing through both halves for rotatingly supporting the axle. The axle has a hub for keeping the axle in the hole while allowing the arm to freely rotate about the axle.

9 Claims, 2 Drawing Sheets

WHIRLING BANNER OR KERCHIEF

BACKGROUND OF THE INVENTION

The present invention relates to a whirling banner or kerchief suitable for use by cheerleaders, drill squads, spectators or demonstrators.

Pom poms, pennants, T-shirts, and the like have long been distributed at sporting events and other public gatherings as promotion gimmicks or crowd pleasers. Not only do such objects serve to entice onlookers and boost attendance, but they can create spectacular displays of mass movement. Such visual effects are particularly desired at filmed or televised events.

It is therefore an object of the present invention to provide a uniquely-constructed, novel whirling banner.

Another object of the present invention is to provide a novel whirling banner which is easy to assemble and economical to produce, particularly in large quantities.

An additional and further object of the present invention is to provide a whirling banner that is sufficiently sturdy to endure the punishment and abuse inherent in the whirling banner's use by an enthusiast, spectator or performer.

A still further object of the present invention is to provide a whirling banner on which logos, advertising and promotional slogans can easily be printed. Furthermore, it is an object of the present invention to provide a whirling banner with a detachable portion for containing coupons, premiums, or other promotional incentives.

Another object of the present invention is to provide a whirling banner which is simple to use and creates an impressive dramatic effect, particularly when used in large groups by many spectators or participants.

SUMMARY OF THE INVENTION

In accordance with the above objects there has been provided a whirling banner, comprising a banner member having an edge, a handle member having an axle portion, and a radial arm member having means for attaching the banner and means for rotatingly supporting the axle portion.

The arm member has first and second ends, means for attaching the banner at the first end, and means for rotatingly supporting the axle portion at the second end. The banner is whirlable around the axle portion when the handle member is held.

According to a preferred embodiment of the present invention, the radial arm member comprises a lower half and an upper half bent over the lower half, thereby defining a fold at one of the first and second ends.

According to a still further embodiment, the means for rotatingly supporting the axle portion comprises a hole passing through the upper and lower halves of the arm member for rotatingly supporting the axle portion.

A means for attaching the banner preferably comprises a barb member attached to one of the upper and lower halves for engaging the banner and for engaging the other of the two halves of the arm. Preferably, the barb member engages a hole in the other half of the arm.

Preferably, the axle portion comprises a hub for engaging the means for rotatingly supporting it.

In a further preferred embodiment, the handle portion is disk-shaped, and the axle portion extends from the periphery of the handle portion. Also, the handle portion comprises a detachable, coin-shaped portion concentric with the periphery of the handle portion, and suitable for having in advertisement or the like printed or emblazoned thereon.

More preferably, the banner is a kerchief with a reinforced border or hem, which is easily detached from the arm means for use as a normal kerchief.

Further, objects, features and advantages of the present invention will become apparent from the brief description of the preferred embodiment, which follows, when considered in combination with the attached figures of drawing.

DESCRIPTION OF THE PREFERRED EMBODIMENT

Figure 1:
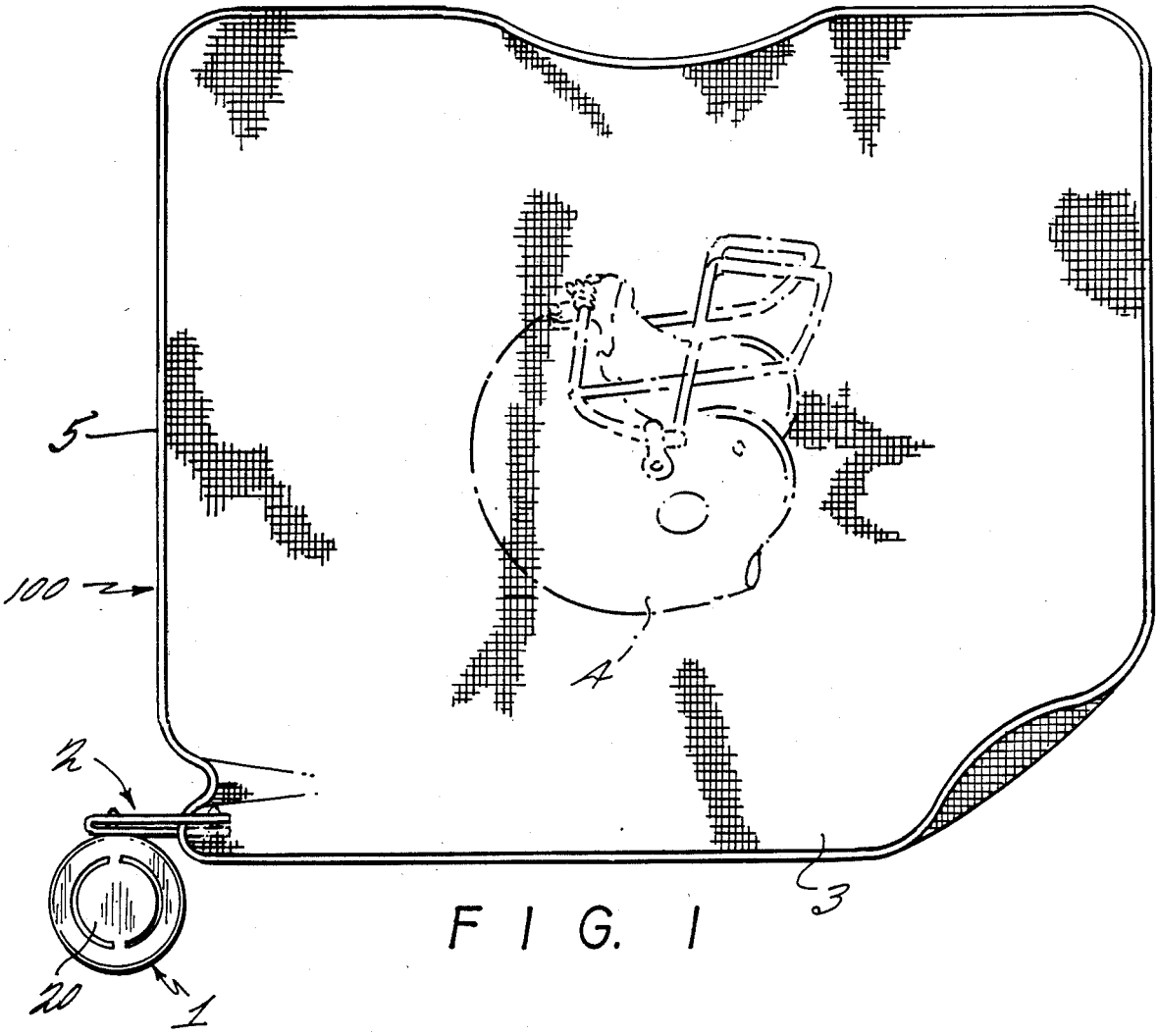
FIG. 1 is a side view of the whirling banner.

FIG. 1 is a side view of the handle portion 1 and radial arm portion 2 and a top view of banner 3. The arm portion 2 is shown attached to the banner 3. The banner is suitable for having an emblem, advertisement, or slogan emblazoned or printed thereon. Banner 3 is shown in FIG. 1 to have an emblem 4 printed thereon as shown in dotted lines. Banner 3 also has a reinforced border 5 for allowing radial arm 2 to be securely attached, and preventing radial arm 2 from ripping through the cloth of Banner 3 when the whirling banner is in use.

Banner 3 may be a kerchief or any other cloth, textile or other suitable material. Banner 3 is preferably brightly-colored to create an impressive visual effect in use.

Figure 2:
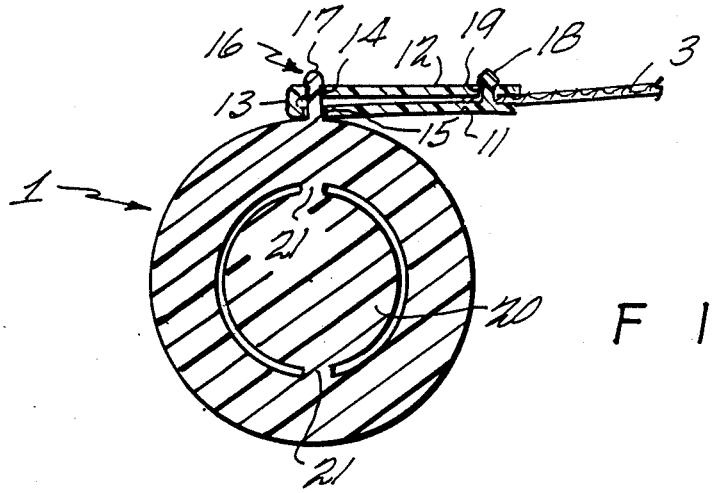
FIG. 2 is a cross-sectional view of the handle portion, radial arm and banner portion.

FIG. 2 is a cross-sectional view of handle portion 1, radial arm portion 2 and banner 3. Radial arm 2 comprises lower half 11 and upper half 12 folded over one another at fold 13. Holes 14 and 15 are provided near fold 13 for rotatingly supporting axle portion 16. Axle portion 16 further comprises hub 17, in the form of a bulb at the end of the axle portion 16. Hub 17 prevents the axle portion from slipping out of the holes while allowing axle 16 to freely rotate.

Radial arm portion 2 further comprises barb 18 attached to lower half 11. Barb 18 pierces the banner 3 and engages upper half 12 by means of hole 19. Handle portion 1 further comprises coin-shaped detachable portion 20, attached to handle portion 1 by tabs 21.

Figure 3:
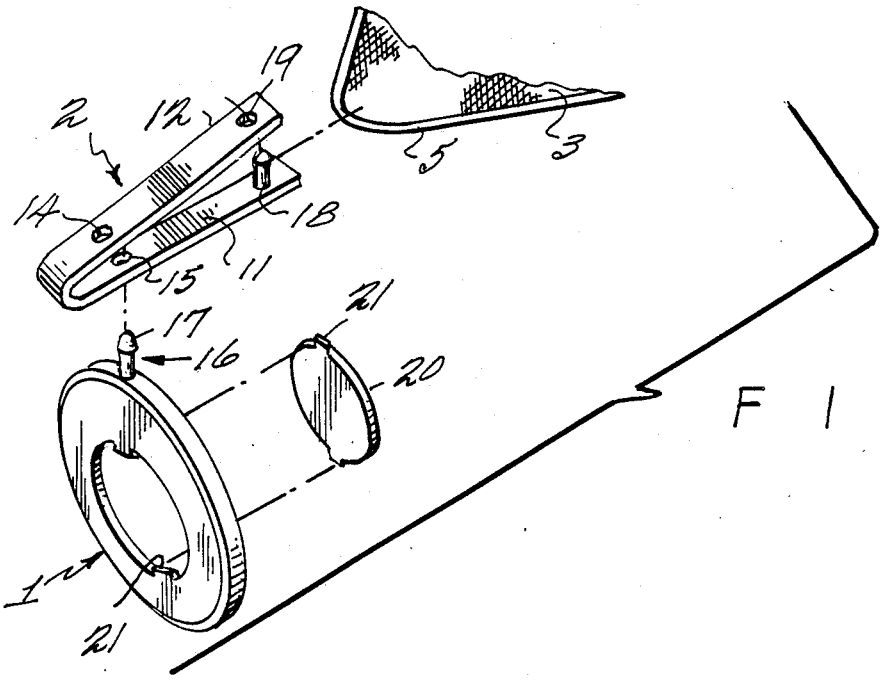
FIG. 3 is an exploded view of the whirling banner of FIG. 1.

FIG. 3 is an exploded view of the whirling banner generally designated 100 in FIG. 1. Whirling banner 100 is assembled by first piercing banner 3 at an appropriate point inside of reinforced border 5 in order to establish a secure hold. Barb 18 is then forced into hole 19 and holds halves 1 and 12 together by means of a friction fit. After barb 18 is inserted into hole 19, axle portion 16 is inserted into holes 14, 15 of handle portion 2. Hub 17 of axle portion 16 rotatingly engages hole 14, and prevents the axle portion from slipping out of holes 14, 15 while allowing free rotation of radial arm portion 2.

Coin-shaped portion 2 is detached from handle portion 1 by breaking tabs 21 by cutting, twisting or tearing in any suitable fashion. Coin-shaped portion 20 is suitable for having coupons, premiums or other promotional incentives, not shown, printed thereon. Coin-shaped portion 20 may also serve as a memento after the remainder of the whirling banner is discarded.

Figure 4:
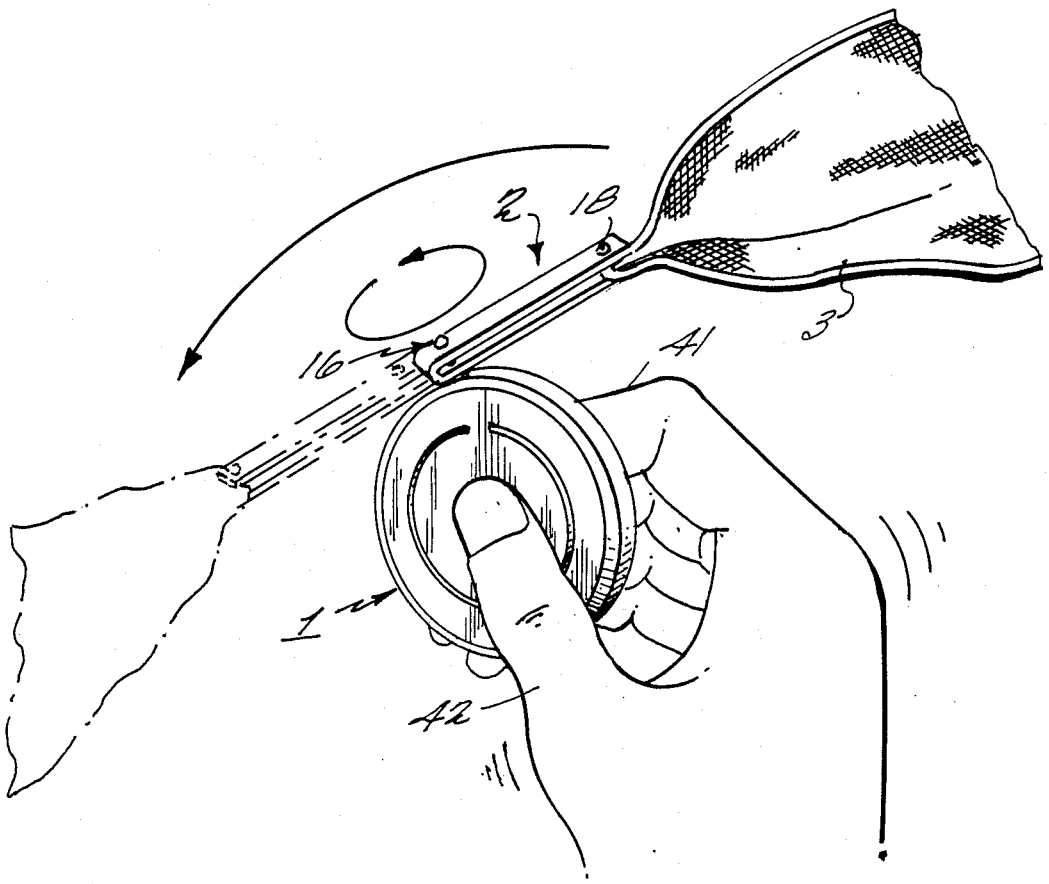
FIG. 4 is perspective, sectional view of the whirling banner in operation.

FIG. 4 shows the whirling banner 100 in operation. Handle portion 1 is grapsed between thumb 42 and forefinger 41, or in any other suitable fashion. After an initial circular motion to start the banner 3 revolving about axis portion 16, a simple back and forth motion of the hand is sufficient to maintain the banner whirling about axle 16.

While a preferred embodiment of the present invention has been illustrated in particular detail, it will be understood that variations and modifications may be effected without departing from the spirit and scope of the novel concepts of this invention.

What is claimed is:

1. A whirling banner, comprising:

a. a banner member having an edge;

b. a handle member having an axle portion; and c. a radial arm member having first and second ends, having a lower half and an upper half bent over the lower half, thereby defining a fold at one of the first and second ends, and having means for attaching said banner at the first end and means for rotatingly supporting said axle portion at the second end, said means for rotatingly supporting the axle portion comprising a hole passing through each of the upper and lower halves, for rotatingly supporting the axle portion, wherein the axle portion further comprises hub means for rotatingly engaging the means for supporting, said banner being whirlable around said axle when said handle member is held and moved back and forth.

2. A banner according to claim 1, wherein said banner member is a kerchief.

3. A banner according to claim 2, wherein said kerchief is easily detachable from said means for attaching said banner, for use as a normal kerchief.

4. A banner according to claim 2, wherein the edge of said kerchief comprises a hem or reinforced border.

5. A banner according to claim 1, wherein said means for attaching the banner comprises a barb member attached to one of said upper and lower halves for engaging said banner and for engaging the other of said halves.

6. A banner according to claim 5, wherein said barb member engages a hole in the other of said halves.

7. A banner according to claim 1, wherein said handle portion comprises a detachable portion.

8. A banner according to claim 1, wherein said handle portion is disk-shaped and has a periphery and wherein said axle portion extends from the periphery of the handle portion.

9. A banner according to claim 8, wherein said handle portion comprises a detachable coin-shaped portion concentric with said periphery.

* * * * *